US005644018A

United States Patent [19]

Kojima et al.

[11] Patent Number: 5,644,018

[45] Date of Patent: Jul. 1, 1997

[54] PITCH WITH REDUCED TENDENCY TO SMOKE DURING SPINNING AND A PROCESS FOR THE PRODUCTION OF SAID PITCH

[75] Inventors: Takashi Kojima; Yasuhiro Hirai; Takafumi Yoshimura, all of Ibaraki-ken, Japan

[73] Assignee: Mitsubishi Gas Chemical Company, Inc., Tokyo, Japan

[21] Appl. No.: 491,354

[22] Filed: Jun. 30, 1995

[30] Foreign Application Priority Data

Jul. 11, 1994 [JP] Japan ..... 6-158780

[51] Int. Cl.$^6$ ..... C10C 3/02

[52] U.S. Cl. ..... 528/247; 208/22; 208/39; 208/44; 585/11; 585/422; 585/426

[58] Field of Search ..... 208/39, 22, 44; 585/11, 422, 426; 528/247

[56] References Cited

U.S. PATENT DOCUMENTS 4,789,455 12/1988 Mochida et al. ..... 208/39

4,891,126 1/1990 Mochida et al. ..... 208/39

5,091,072 2/1992 Tsuchitani et al. ..... 208/39

5,182,010 1/1993 Mochida et al. ..... 208/39

*Primary Examiner*—Nathan M. Nutter

*Attorney, Agent, or Firm*—Roylance, Abrams, Berdo & Goodman, L.L.P.

[57] ABSTRACT

Mesophase pitch that has a softening point of no more than 250° C., a pyridine-insolubles content of no more than 50% and a n-heptane solubles content of 3–10%, with the n-heptane solubles experiencing a weight loss of no more than 15% at 450° C. as measured by thermogravimetry is produced by polymerizing a condensed polycyclic aromatic hydrocarbon or a substance containing it in the presence of HF and $BF_3$. This mesophase pitch is suppressed satisfactorily in its tendency to smoke during spinning and, additionally, it has a low enough softening point to exhibit outstanding spinnability. Hence, the pitch allows for high-volume spinning to be performed continuously for a prolonged time without causing extensive fouling of the surface of spinning nozzles.

13 Claims, No Drawings

PITCH WITH REDUCED TENDENCY TO SMOKE DURING SPINNING AND A PROCESS FOR THE PRODUCTION OF SAID PITCH

BACKGROUND OF THE INVENTION

This invention relates to pitch for use in the manufacture of high-performance carbon fibers and a process for the production of said pitch. More particularly, the invention relates to mesophase pitch of a type that is produced by polymerizing condensed polycyclic aromatic hydrocarbons or substances containing them in the presence of $HF/BF_3$ and which is reduced in the tendency to smoke during the spinning.

Processes for producing mesophase pitch by polymerizing condensed polycyclic aromatic hydrocarbons or substances containing them in the presence $HF/BF_3$ are described in U.S. Pat. No. 4,789,455 and U.S. Pat. No. 4,891,126. U.S. Pat. No. 4,891,126 also teaches mesophase pitch that is produced by polymerizing naphthalene, anthracene, phenanthrene, pyrene and other skeleton containing condensed polycyclic hydrocarbons in the presence of $HF/BF_3$. U.S. Pat. No. 5,182,010 discloses mesophase pitch that is produced by polymerizing naphthalene derivatives such as methylnaphthalene that have at least one methyl group. The mesophase pitch of the kinds described in these prior patents is drawing increasing attention as a precursor of inexpensive carbon artifacts since it does not require complicated steps in polymerization.

The mesophase pitch is also used as a precursor of high-performance carbon fibers and in this case it is important that the pitch (1) be homogeneous in the absence of gels and (2) contain the least amounts of light substances which will either foul spinning nozzles due to smoking during spinning or cause structural defects. To meet these requirements, light components are distilled off the pitch. Since the light components to be removed have boiling points of about 500°–700° C. at atmospheric pressure, the operation of their removal must inevitably be performed under high-temperature conditions. As a result, a pyrolytic reaction occurs to cause an unwanted reaction for the generation of light components, making it difficult to achieve complete removal of the light components from the pitch; additionally, a reaction for conversion to heavy substances also occurs due to thermal polymerization and not only are formed by product gels but also the softening point of the pitch will increase abnormally, presenting considerable difficulty in using it as a precursor of high-performance carbon fibers.

SUMMARY OF THE INVENTION

An object, therefore, of the present invention is to provide mesophase pitch of a type that is produced by polymerizing a condensed polycyclic aromatic hydrocarbon or a substance containing it in the presence of $HF/BF_3$ and which is suitable for use as a precursor of high-performance carbon fibers since it has a small content of light substances which will cause smoking during spinning and because it has outstanding spinnability in the absence of gels.

The present inventors conducted intensive studies with a view to solving the aforementioned problems of the mesophase pitch that is produced by polymerizing a condensed polycyclic aromatic hydrocarbon or a substance containing it in the presence of $HF/BF_3$. As a result, the inventors found that when light components were removed after performing polymerization in the presence of the $HF/BF_3$ catalyst in amounts of a specified range at temperatures of a specified range, a precursor pitch could be obtained that was reduced in the tendency to smoke during spinning and which also had outstanding spinnability. The present invention has been accomplished on the basis of this finding.

Thus, according to its first aspect, the present invention provides pitch with reduced tendency to smoke during spinning that is produced by polymerizing a condensed polycyclic aromatic hydrocarbon or a substance containing it in the presence of $HF/BF_3$, that contains an optically anisotropic phase in an amount of substantially 100%, that has a softening point of no more than 250° C., a pyridine-insolubles content of no more than 50%, and an n-heptane solubles content of 3–10%, with the n-heptane solubles experiencing a weight loss of no more than 15% at 450° C. as measured by thermogravimetry.

According to its second aspect, the present invention provides a process for producing pitch with reduced tendency to smoke during spinning that contains an optically anisotropic phase in an amount of substantially 100%, that has a softening point of no more than 250° C., a pyridine-insolubles content of no more than 50%, and a n-heptane solubles content of 3–10%, with the n-heptane solubles experiencing a weight loss of no more than 15% at 450° C. as measured by thermogravimetry, which process comprises:

a polymerization step which starts with a condensed polycyclic aromatic hydrocarbon or a substance containing it and which performs polymerization in the presence of 0.2–0.5 moles of HF and 0.06–0.15 moles of $BF_3$ per mole of the starting material at a reaction temperature that is no less than 240° C. and that is within the range specified by formula (I), thereby producing pitch the optically anisotropic phase content of which is substantially 100%:

$$6.0/B+205 \geqq T \geqq 6.0/B+190 \quad (I)$$

(where T is the reaction temperature in °C. and B is the number of moles of $BF_3$ per mole of the condensed polycyclic aromatic hydrocarbon as the starting material); and a refining step in which the product polymer is freed of light components at a temperature of no more than 480° C. and either in vacuo at a reduced pressure of no more than 20 Torr or under the flow of an inert gas.

DETAILED DESCRIPTION OF THE INVENTION

The present invention will now be described in detail.

The pitch according to the first aspect of the invention has a softening point of no more than 250° C., preferably 200°–250° C. If the softening point of the pitch exceeds 250° C., fiber breakage will often occur during spinning and it is difficult to perform a consistent spinning operation. If the softening point of the pitch is less than 200° C., it is impossible to produce mesophase pitch that contains an optically anisotropic phase in an amount of substantially 100%.

The pyridine-insolubles content of the pitch is no more than 50%, preferably no more than 45%, more preferably in the range from 30 to 45%. If the pyridine-insolubles content of the pitch exceeds 50%, gelled components will enter, making it difficult to produce high-performance carbon fibers. In addition, the life of a spinning filter is shortened or, in an extreme case, spinning nozzles will clog during spinning, thus presenting difficult in assuring consistent spinning operations. If the pyridine-insolubles content of the pitch is less than 30%, there will not be sufficient large molecules to form oriented structures during spinning, thus making it difficult to produce high-performance carbon fibers.

Generally speaking, the n-heptane solubles are pitch components of relatively low molecular weights that contain causative substances for the occurrence of smoking during spinning and which are prone to generate such causative substances upon decomposition. From the viewpoint of suppressing the occurrence of smoking during spinning, it is desired that the n-heptane solubles have high heat resistance and be present in the smallest possible amounts. On the other hand, they are the plastic components necessary to develop satisfactory spinnability and should be present in suitable amounts.

Therefore, the pitch of the invention is specified such that the n-heptane soluble component has sufficient heat resistance to experience a weight loss of no more than 15% at 450° C. as measured by thermogravimetry and that the content of said n-heptane soluble component is 3–10%.

Thus, the pitch of the invention which contains a suitable amount of the n-heptane solubles having a highly heat-resistant structure can be used as a precursor of high-performance carbon fibers that is suppressed the tendency to smoke during spinning and which also has satisfactory spinnability.

The mesophase pitch of the invention is produced from condensed polycyclic aromatic hydrocarbons by the specified method using the $HF/BF_3$ catalyst. Having the aforementioned properties, the pitch is sufficiently suppressed in the tendency to smoke during spinning and it has a low enough softening point to insure good spinnability; as a result, continuous fibers can be spun in large quantities from this pitch for a prolonged time without causing extensive fouling of the surfaces of spinning nozzles.

The process for producing the above-described pitch according to the second aspect of the invention will now be described.

The pitch of the invention is prepared from condensed polycyclic aromatic hydrocarbons or substances containing them. Exemplary condensed aromatic hydrocarbons include naphthalene, anthracene, phenanthrene, pyrene, and compounds having these skeletons such as methylnaphthalene.

The pitch of the invention can be produced by two major steps, a polymerization step in which one or more of the condensed polycyclic aromatic hydrocarbons listed above are polymerized in the presence of $HF/BF_3$ to give mesophase pitch that contains an optically anisotropic phase in an amount of substantially 100%, and a refining step in which light components are removed from the mesophase pitch prepared in the polymerization step.

In the polymerization step, it is important to control the process conditions in such a way that even if light components are removed at comparatively high temperatures in the subsequent refining step, there will be provided pitch having reduced tendency to smoke during spinning that will not yield by-product gels and that has a low enough softening point to exhibit outstanding spinnability.

To meet this requirement, the $HF/BF_3$ catalyst is used in the polymerization step in such amounts that the HF content ranges from 0.2 to 0.5 moles whereas that of $BF_3$ ranges from 0.06 to 0.15 moles per mole of the condensed polycyclic aromatic hydrocarbon. The reaction temperature should be at least 240° C. and within the range that satisfies the following relation (I) with the amount of $BF_3$:

$$6.0/B+205 \geqq T \geqq 6.0/B+190 \quad (I)$$

where T is the reaction temperature in °C. and B is the number of moles of $BF_3$ per mole of the condensed polycyclic aromatic hydrocarbon as the starting material.

In the polymerization of condensed polycyclic aromatic hydrocarbons using $HF/BF_3$, pitch of the higher degree of polymerization can generally be produced by increasing the amount of $BF_3$ or the reaction temperature. It should, however, be noted that mesophase pitch species having the same softening point can be produced by combining reaction conditions selected from an extremely wide range, including the combination of high $BF_3$ content with low reaction temperature, as well as the combination of low $BF_3$ content with high reaction temperature.

The $BF_3$ content and the reaction temperature are particularly important for the purposes of the present invention and reaction conditions advantageous for providing the pitch of the invention are selected by combining the very narrow range of $BF_3$ content with the reaction temperature of the range that is not lower than 240° C. and which is specified in relation to the $BF_3$ content.

If the reaction temperature is lower than 240° C., it is difficult to produce mesophase pitch which is substantially 100% in the content of an optically anisotropic phase.

In the polymerization step of the process for producing the pitch of the invention, $BF_3$ is used in an amount ranging from 0.06 to 0.15 moles per mole of the condensed polycyclic aromatic hydrocarbon. If more than 0.15 moles of $BF_3$ is used per mole of the condensed polycyclic aromatic hydrocarbon, the resulting pitch no longer has a homogeneous structure but it is dominated by inhomogeneity consisting of low-molecular weight components rich in an aliphatic structure and high-molecular weight components which have high thermal reactivity and high aromaticity. Even if one attempts to remove light components which are present in the n-heptane soluble component of the pitch, the low-molecular weight components having low heat stability will undergo simultaneously occurring pyrolysis and cannot be removed completely. In addition, the high-molecular weight components having high thermal reactivity will deteriorate so rapidly that the softening point of the pitch will increase significantly, thereby increasing the chance for the formation of gels. If the reaction temperature is sufficiently reduced, the amount of the high-molecular weight components can be reduced accordingly but, then, it is no longer possible to provide mesophase pitch which contains an optically anisotropic phase in an amount of substantially 100%.

If $BF_3$ is used in an amount less than 0.06 moles per mole of the starting material, the polymerization reaction will not proceed satisfactorily to yield the desired mesophase pitch unless high-temperature conditions are employed. As in the above-described case of using unduly large amounts of $BF_3$, the resulting pitch no longer has a homogeneous structure and it is difficult to produce mesophase pitch that is suppressed in the tendency to smoke during spinning and which also has good spinnability. The same discussion will hold in the case where the reaction temperature is outside the range specified by the invention although the $BF_3$ content is within the range specified by the invention. Stated more specifically, the structural homogeneity of the pitch is not assured if the reaction temperature is unduly high; on the other hand, if the reaction temperature is unduly low, the desired mesophase pitch is not obtainable or, alternatively, the proportion of light components will increase so much that a greater burden will be imposed on the subsequent refining step and a lower yield will also occur.

The reaction time for the polymerization step ranges generally from 30 to 300 min, preferably from 60 to 240 min. The greater part of the reaction will be complete in about 60 min after the start of polymerization and, hence, it is not advisable to carry out the polymerization reaction for a prolonged time.

By performing the polymerization under such conditions that $BF_3$ is used in amounts over the range specified by the invention whereas the reaction temperature is specified in relation to the $BF_3$ content, the proportion of the formation of high-molecular weight components which are prone to generate gels can be so controlled that the resulting pitch will not have an inhomogeneous structure which consists of low-molecular weight components rich in an aliphatic structure and high-molecular weight components having high aromaticity. The mesophase pitch that is produced under these conditions will not yield by-product gels even if it is placed under comparatively high-temperature conditions in the subsequent refining step and, in addition, the light components which will cause smoking during spinning are sufficiently heat-resistant to allow for their removal within a short time.

Compared to the $BF_3$ content and the reaction temperature, the HF content is less influential on the properties of the pitch to be produced and HF is typically employed in an amount of about 2–5 moles per mole of $BF_3$.

We now describe the refining step which follows the polymerization step in the process for producing the pitch of the invention.

The mesophase pitch that has been prepared in the polymerization step and the content of an optically anisotropic phase in which is substantially 100% is subsequently refined so that it will have reduced tendency to smoke during spinning. To this end, it is necessary that the pitch be purified at a temperature not higher than 480° C. and either in vacuo at a reduced pressure of no more than 20 Torr or under the flow of an inert gas, thereby insuring that undesired low-molecular weight components will be positively purged from the system. In this case, a thin-film processor, or an apparatus for melting the pitch and spreading it at as a thin film, may be employed in order to increase the area of evaporation from the pitch, with evaporation being preferably conducted at 380°–480° C. If the temperature for evaporation is lower than 380° C., the efficiency is low since the light components to be removed have unduly low vapor pressures; if the evaporation temperature is above 480° C., the progress of thermal polymerization reaction is so marked that it is difficult to suppress the formation of gels.

If purification is to be performed in vacuo, the degree of vacuum is no more than 20 Torr, preferably no more than 10 Torr, more preferably 5 Torr or less. The degree of vacuum should be high enough to insure the least presence of light components.

If purification is to be performed under the flow of an inert gas, the latter is preferably allowed to flow in a quantity of at least 1 $Nm^3/h$ per kilogram of the pitch to be refined. When an inert gas is used, that portion of the light components which corresponds to their vapor pressure at the operation temperature is effectively removed as it is carried by the inert gas. If the inert gas is allowed to flow in quantities smaller than the stated value, prolonged residence at elevated temperature is necessary but then the pitch being refined will deteriorate to cause marked formation of by-products gels.

To evaluate "smoking during spinning", spinning is performed with a multi-hole nozzle, usually having 50 or more holes, and appropriate parameters are measured, such as the amount of smoke that develops, the degree of fouling of the nozzle surface and the time for which continuous spinning can be made. Alternatively, a convenient method may be employed, as exemplified by thermogravimetric measurement of the decrease in weight that occurs under vacuum. Stated more specifically, a pitch sample weighing about 6 mg is heated at 10° C./min, with the interior in the measurement system held in vacuo at a reduced pressure of 4 Torr, until the viscosity decreases to 600 poises and the resulting weight loss is measured. One may safely conclude that if the weight loss as measured by this convenient method is 0.6% or less, spinning with a multi-hole nozzle can be performed with minimum smoking, reduced fouling of the nozzle surface, lower frequency of wiping operations and over a prolonged time.

The term "optically anisotropic phase" as used hereinabove means that portion of a pitch mass which, after being solidified at near-room temperature, cut through a section, polished on the cut surface and examined with a reflecting optical microscope under crossed Nicols, develops luster as the sample or crossed Nicols are rotated. The "content of an optically anisotropic phase" means the percentage of the area of the "optically anisotropic phase" as determined under examination with a microscope. The "mesophase pitch" is a pitch containing the "optically anisotropic phase".

The "softening point of pitch" refers to the temperature, as measured by a flow tester method, at which a pitch transition from the solid to liquid state occurs.

The term "pyridine-insolubles" (abbreviated as PI) means a component that remains after the pyridine solubles obtained by the following method are removed: a pitch power is put into a cylinder of filter paper having an average pore size of 1 μm and subjected to extraction with pyridine on a Soxhlet extractor for 18 h under heating. The term "n-heptane solubles" (abbreviated as HS) means a solvent-soluble component that is obtained by the following procedure: the above-described method is repeated to perform extraction with benzene on a Soxhlet extractor for 18 h under heating, thereby giving the benzene-solubles and, then, the solvent benzene is distilled off to produce a benzene-soluble powder, which is subjected to extraction with n-heptane on a Soxhlet extractor for 18 h under heating.

The following examples are provided for the purpose of further illustrating the present invention but are in no way to be taken as limiting.

EXAMPLE 1

Naphthalene was polymerized at 255° C. for 4 h using 0.35 moles of HF and 0.1 mole of $BF_3$ per mole of naphthalene. Thereafter, the pressure in the reactor was reduced to one atmosphere and the catalysts were recovered. With the temperature subsequently raises to 340° C., nitrogen preheated at 340° C. was admitted into the reactor from the bottom at a rate of 3 L/kg per minute for 5 h, whereby the residual small amounts of the catalysts were completely removed. The pitch thus prepared had an optically anisotropic phase content of substantially 100% and its softening point was 213° C.

The pitch was subsequently fed through an uniaxial extruder and the molten pitch was fed at a rate of 8 $kg/m^2/h$ into a vertical thin-film processor having three agitating blades so that the light components were removed at 430° C.×3 Torr. The refined pitch had a softening point of 245° C., a pyridine-insolubles content of 32.6%, and a n-heptane solubles content of 8.3%; the n-heptane solubles experienced 11.1% weight loss at 450° C.

The pitch was evaluated for smoking during spinning by the convenient method using thermogravimetry; the weight loss that occurred upon heating at 4 Torr up to a temperature that caused a viscosity reduction to 600 poises was as small as 0.49%. To check the spinnability of the refined pitch, a spinning experiment was conducted with a single-hole spinning machine; a fiber could be spun in a highly consistent manner even when it was taken up at a speed of 500 m/min.

COMPARATIVE EXAMPLE 1

Polymerization reaction and refining were performed as in Example 1, except that the temperature for the polymerization reaction was raised to 280° C. The refined pitch had the properties shown in Table 1 below, from which one can see that the softening point and the pyridine-insolubles content of the pitch were outside the ranges specified by the invention and that the n-heptane solubles were poor in heat resistance. Hence, the pitch did not give satisfactory results in the evaluation of smoking by the convenient method or in the evaluation of spinnability. Additionally, the 10-μm filter fitted right above the single-hole nozzle clogged and the spinning experiment could not be continued any further.

COMPARATIVE EXAMPLE 2

Polymerization reaction and refining were performed as in Example 1, except that the temperature for the polymerization reaction was lowered to 240° C. The refined pitch had the properties shown in Table 1, from which one can see that the content of an optically anisotropic phase in the pitch was not 100% and that the n-heptane solubles content was as much as 14%. Hence, the pitch did not give satisfactory results in the evaluation of smoking by the convenient method. In the experiment with a spinning machine having a single-hole nozzle, the pitch was extruded at erratic speeds from the nozzle and consistent spinning could be performed.

COMPARATIVE EXAMPLE 3

Polymerization reaction and refining were performed as in Example 1, except that HF and $BF_3$ were used in 0.40 and 0.17 moles, respectively, per mole of naphthalene and that the reaction temperature was lowered to 240° C. The refined pitch had the properties shown in Table 1. Since the n-heptane insolubles were poor in heat resistance, the pitch did not give satisfactory results in the evaluation of smoking by the convenient method.

The result of the spinnability test was fairly satisfactory when the takeup speed was 200 m/min but the spun fiber could not be taken up consistently at an increased speed of 500 m/min.

COMPARATIVE EXAMPLE 4

Polymerization reaction and refining were performed as in Example 1, except that HF and $BF_3$ were used in 0.25 and 0.05 moles, respectively, per mole of naphthalene and that the reaction temperature was raised to 300° C. The refined pitch had the properties shown in Table 1. Since the n-heptane insolubles were poor in heat resistance, the pitch did not give satisfactory results in the evaluation of smoking by the convenient method. A fiber could not be spun consistently in the spinnability test. Examination after the test revealed that gels had deposited on the filter fitted just above the nozzle.

TABLE 1

| | Ex. 1 | Comp. Ex. 1 | Comp. Ex. 2 | Comp. Ex. 3 | Comp. Ex. 4 |
|---|---|---|---|---|---|
| (Polymerization condition) | | | | | |
| HF naphthalene molar ratio | 0.35 | 0.35 | 0.35 | 0.40 | 0.25 |
| $BF_3$ naphthalene molar ratio | 0.10 | 0.10 | 0.10 | 0.17 | 0.05 |
| Reaction temperature, °C. | 255 | 280 | 240 | 240 | 300 |
| Reaction time, h | 4 | 4 | 4 | 4 | 4 |
| (Properties of the product) | | | | | |
| Anisotropic content, % | 100 | 100 | 85 | 100 | 100 |
| Softening point, °C. | 245 | 264 | 225 | 252 | 256 |
| PI, wt % | 32.6 | 51.8 | 19.7 | 48.2 | 53.4 |
| HS, wt % | 8.3 | 6.9 | 14.0 | 7.6 | 5.4 |
| HS 450 weight loss, % | 11.1 | 22.3 | 13.6 | 19.7 | 24.9 |
| (Evaluation) | | | | | |
| Smoking in convenient method, wt % | 0.49 | 1.15 | 0.80 | 0.82 | 1.26 |
| Spinnability | Good | Fibers broke and the nozzle clogged | Erratic extrusion | Inconsistent | Fibers broke |

PI: the content of pyridine-insolubles
HS: the content of n-heptane solubles
HS 450 weight loss: weight loss in the n-heptane solubles as measured by thermogravimetry after occurring at 450° C.
Smoking in conventional method: weight loss as measured by thermogravimetry after heating to 600 poises at 4 Torr

EXAMPLE 2

Polymerization was performed as in Example 1, except that HF and $BF_3$ were used in 0.35 and 0.13 moles, respectively, per mole of naphthalene and that the temperature for polymerization was lowered to 250° C. Thereafter, nitrogen preheated at 430° C. was introduced into the thin-film processor through an inlet below the rotating blades at a rate of 2 $Nm^3/kg$ so as to remove the light components.

The refined pitch had a softening point of 248° C., a pyridine-insolubles content of 42.8% and a n-heptane solubles content of 7.5%. The n-heptane solubles experienced a weight loss of 12.8% at 450° C.

The pitch gave a satisfactory result in the evaluation of smoking during spinning by the convenient method. In the test for evaluating spinnability, a fiber could be spun in a very consistent manner at a takeup speed of 500 m/min.

EXAMPLE 3

Polymerization was performed as in Example 1, except that HF and $BF_3$ were used in 0.32 and 0.09 moles, respectively, per mole of naphthalene and that the temperature for polymerization was raised to 270° C. Nitrogen was introduced as in Example 2 at a rate of 2.5 $Nm^3/kg$ so as to remove the light components.

The refined pitch had a softening point of 243° C., a pyridine-insolubles content of 43.5% and an n-heptane insolubles content of 6.2%. The n-heptane solubles experienced a weight loss of 10.9% at 450° C.

The pitch was evaluated for smoking during spinning by the convenient method; the weight loss that occurred upon heating at 4 Torr up to a temperature that caused a viscosity reduction to 600 poises was as small as 0.40%. Fibers were actually spun from the pitch as it was extruded through a 100-hole nozzle at a temperature (317° C.) that caused the viscosity of the pitch to be reduced to 600 poises and taken up at a speed of 350 m/min to provide a fiber diameter of 12 μm. The occurrence of smoking was negligible and a consistent spinning operation was insured.

The mesophase pitch of the invention is suppressed satisfactorily in its tendency to smoke during spinning; additionally, it has a sufficiently low softening point to exhibit outstanding spinnability. Therefore, the pitch of the invention allows for high-volume spinning to be performed continuously for a prolonged time without causing extensive fouling of the surface of spinning nozzles.

What is claimed is:

1. Pitch with reduced tendency to smoke during spinning and having good spinnability produced by (a) polymerizing a compound selected from the group consisting of a condensed polycyclic aromatic hydrocarbon and a substance containing a condensed polycyclic aromatic hydrocarbon in the presence of $HF/BF_3$, and then (b) refining the polymerization product of (a) by freeing said product of light components wherein said pitch contains an optically anisotropic phase in an amount of substantially 100%, wherein said pitch has a softening point of no more than 250° C., a pyridine-insolubles content of no more than 50%, and a n-heptane solubles content of 3–10%, and wherein the n-heptane solubles experience a weight loss of no more than 15% at 450° C. as measured by thermogravimetry.

2. The pitch of claim 1 which has a softening point of 200°–250° C.

3. The pitch of claim 1 which has a pyridine-insolubles content of 30–45%.

4. A process for producing pitch with reduced tendency to smoke during spinning and having good spinnability said pitch containing an optically anisotropic phase in an amount of substantially 100%, and said pitch having a softening point of no more than 250° C., a pyridine-insolubles content of no more than 50%, and a n-heptane solubles content of 3–10%, wherein said n-heptane solubles experience a weight loss of no more than 15% at 450° C. as measured by thermogravimetry, the process comprising the steps of:

(a) polymerizing a starting material selected from the group consisting of a condensed polycyclic aromatic hydrocarbon and a substance containing a condensed polycyclic aromatic hydrocarbon in the presence of 0.2–0.5 moles of HF and 0.06–0.15 moles of $BF_3$ per mole of the starting material at a reaction temperature that is no less than 240° C. and that is within the range specified by the formula $$6.0/B+205 \geqq T \geqq 6.0/B+190$$

wherein T is the reaction temperature in °C. and B is the number of moles of $BF_3$ per mole of said starting material to thereby produce pitch containing an optically anisotropic phase in an amount of substantially 100%; and (b) refining the product of step (a) by freeing said product of light components at a temperature of 380° C.–480° C.

5. The process of claim 4, wherein an apparatus for allowing molten pitch to spread in a thin film is employed in the refining step.

6. The process of claim 5, wherein the refining step is carried out at a temperature of 380°–480° C.

7. The process of claim 5, wherein an inert gas is allowed to flow in a quantity of at least 1 $Nm^3/h$ per kilogram of the starting pitch.

8. The process of claim 4, wherein the polymerization step is carried out for a reaction time of 30–300 min.

9. The process of claim 8, wherein the reaction time is 60–240 min.

10. The process of claim 4, wherein the refining step is carried out at a pressure of no more than 10 Torr.

11. The process of claim 10, wherein the pressure is no more than 5 Torr.

12. The process of claim 4 wherein said refining step is carried out in vacuo at a reduced pressure of no more than 20 Torr.

13. The process of claim 4 wherein said refining step is carried out under the flow of an inert gas.

* * * * *